US009207014B2

(12) United States Patent
Ahn et al.

(10) Patent No.: US 9,207,014 B2
(45) Date of Patent: Dec. 8, 2015

(54) DEHUMIDIFYING APPARATUS FOR DRYER

(71) Applicant: LG ELECTRONICS INC., Seoul (KR)

(72) Inventors: Seung-Phyo Ahn, Changwon (KR); Sang-Ik Lee, Changwon (KR); Byeong-Jo Ryoo, Changwon (KR); Sung-Ho Song, Changwon (KR); Jeong-Yun Kim, Changwon (KR); Yang-Hwan Kim, Changwon (KR); Jae-Hyuk Wee, Changwon (KR); Dong-Hyun Kim, Changwon (KR); Yoon-Seob Eom, Changwon (KR); Yang-Ho Kim, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/186,419

(22) Filed: Feb. 21, 2014

(65) Prior Publication Data

US 2014/0165417 A1 Jun. 19, 2014

Related U.S. Application Data

(63) Continuation of application No. 12/676,269, filed as application No. PCT/KR2008/005184 on Sep. 3, 2008.

(30) Foreign Application Priority Data

Sep. 4, 2007 (KR) ..... 10-2007-0089679
Sep. 13, 2007 (KR) ..... 10-2007-0093288

(51) Int. Cl.
*D06F 58/20* (2006.01)
*F26B 21/08* (2006.01)

(Continued)

(52) U.S. Cl.
CPC ..... *F26B 21/08* (2013.01); *D06F 58/206* (2013.01); *D06F 58/22* (2013.01); *D06F 58/24* (2013.01)

(58) Field of Classification Search
CPC ..... D06F 58/206; D06F 58/22; D06F 58/24; F26B 21/08
USPC ..... 34/72, 73, 74, 79, 83, 130, 134; 62/183
See application file for complete search history.

(56) References Cited

U.S. PATENT DOCUMENTS 2,280,512 A 4/1942 Hemming et al.
2,958,954 A 11/1960 Longenecker (Continued)

FOREIGN PATENT DOCUMENTS

EP 1 550 829 7/2005
EP 1 657 350 5/2006

(Continued)

OTHER PUBLICATIONS

International Search Report dated Feb. 4, 2009 issued in Application No. PCT/KR2008/005182.

(Continued)

*Primary Examiner* — Jiping Lu
(74) *Attorney, Agent, or Firm* — Ked & Associates LLP

(57) ABSTRACT

A dehumidifying apparatus for a dryer is provided that includes a case, a drum disposed inside the case that receives objects to be dried therein, and a hot air supplier that supplies hot air into the drum and dries the objects to be dried. The dehumidifying apparatus includes a heat exchanger that heat exchanges with air flowing from the drum, and an injection nozzle portion disposed between the hot air supplier and the heat exchanger so as to inject a certain jet. When gas introduced into the dehumidifying apparatus from the drum passes through the jet, foreign substances such as lint, contained in the gas may be separated, thereby preventing accumulation of the foreign substances on the dehumidifying apparatus.

17 Claims, 6 Drawing Sheets

(51) Int. Cl.

| | |
|---|---|
| ***D06F 58/22*** | (2006.01) |
| ***D06F 58/24*** | (2006.01) |

(56) References Cited

U.S. PATENT DOCUMENTS

| | | | | |
|---|---|---|---|---|
| 3,050,867 | A | 8/1962 | Friedman | |
| 3,771,238 | A | 11/1973 | Vaughn | |
| 4,067,382 | A | 1/1978 | English | |
| 4,100,964 | A | 7/1978 | Gorchev et al. | |
| 4,103,433 | A | 8/1978 | Taylor | |
| 4,163,469 | A | 8/1979 | English | |
| 4,412,391 | A | 11/1983 | Bolognino | |
| 4,572,429 | A | 2/1986 | Huffman et al. | |
| 4,689,896 | A | 9/1987 | Narang | |
| 4,967,830 | A | 11/1990 | Eubank et al. | |
| 5,142,873 | A | 9/1992 | Ramsey, Jr. | |
| 5,226,203 | A | 7/1993 | Sacconato et al. | |
| 6,151,795 | A | 11/2000 | Hoffman et al. | |
| 6,474,086 | B1 | 11/2002 | Liu | |
| 6,887,125 | B2 | 5/2005 | Kurogouchi | |
| 7,409,776 | B2 | 8/2008 | Ono et al. | |
| 7,895,770 | B2 | 3/2011 | Bae et al. | |
| 7,908,766 | B2 | 3/2011 | Ahn et al. | |
| 7,930,838 | B2 | 4/2011 | Bae et al. | |
| 7,987,616 | B2 | 8/2011 | Bae et al. | |
| 7,992,322 | B2 | 8/2011 | Kim | |
| 7,997,006 | B2 | 8/2011 | Son et al. | |
| 8,042,283 | B2 | 10/2011 | Nakiri | |
| 8,250,777 | B2 | 8/2012 | Kim et al. | |
| 2005/0050644 | A1 * | 3/2005 | Severns et al. | 8/115.51 |
| 2005/0198852 | A1 | 9/2005 | Ono et al. | |
| 2005/0204755 | A1 | 9/2005 | Nishiwaki et al. | |
| 2007/0113421 | A1 | 5/2007 | Uhara et al. | |
| 2008/0307667 | A1 | 12/2008 | Ikemizu | |
| 2009/0094852 | A1 | 4/2009 | Tatsumi et al. | |
| 2009/0282696 | A1 | 11/2009 | Kim et al. | |
| 2010/0058605 | A1 | 3/2010 | Kang | |

FOREIGN PATENT DOCUMENTS

| | | | |
|---|---|---|---|
| EP | 1 820 893 | A1 | 8/2007 |
| JP | 02-255198 | | 10/1990 |
| JP | 08-229297 | | 9/1996 |
| JP | 2005-27768 | A | 2/2005 |
| JP | 2006-181219 | A | 7/2006 |
| JP | 2006-187449 | A | 7/2006 |
| KR | 20-1991-0011654 | U | 7/1991 |
| KR | 10-1993-0013344 | | 7/1993 |
| KR | 2001-096997 | | 11/2001 |
| KR | 2002-058113 | | 7/2002 |
| KR | 10-2002-0085831 | A | 11/2002 |
| KR | 2003-024319 | | 3/2003 |
| KR | 2003-0079093 | | 10/2003 |
| KR | 10-2004-0077338 | | 9/2004 |
| KR | 10-0151966 | | 9/2005 |
| KR | 10-0511966 | B1 | 9/2005 |
| KR | 10-2006-0007470 | | 1/2006 |
| KR | 10-2006-0038796 | | 5/2006 |
| KR | 10-2006-0063401 | | 6/2006 |
| KR | 10-0598383 | B1 | 7/2006 |
| KR | 10-2006-0091375 | | 8/2006 |
| KR | 10-0829125 | B1 | 5/2008 |
| WO | WO 2009/031810 | | 3/2009 |
| WO | WO 2009/031811 | | 3/2009 |

OTHER PUBLICATIONS

International Search Report dated Feb. 16, 2009 issued in Application No. PCT/KR2008/005183.

International Search Report dated Feb. 25, 2009 issued in Application No. PCT/KR2008/005184.

International Search Report for PCT/KR2008/005184 dated Feb. 29, 2009.

Australian Office Action dated Nov. 10, 2010 issued in Application No. 2008295742.

Chinese Office Action dated May 4, 2011 (200880105484.9).

Chinese Office Action dated Jul. 20, 2011. (Application No. 200880105483.4).

* cited by examiner

DEHUMIDIFYING APPARATUS FOR DRYER

CROSS-REFERENCE TO RELATED APPLICATION(S)

This present application is a Continuation of U.S. patent application Ser. No. 12/676,269 filed on Mar. 3, 2010, which is a National Stage Application of PCT/KR2008/005184 filed Sep. 3, 2008, which claims priority to Korean Application Nos. 10-2007-0089679 filed on Sep. 4, 2007 and 10-2007-0093288 filed on Sep. 13, 2007, whose entire disclosures are hereby incorporated by reference.

TECHNICAL FIELD

The present invention relates to a dehumidifying apparatus for a dryer.

BACKGROUND ART

In general, a clothes dryer is a device that absorbs moisture from objects to be dried (load) by blowing hot air generated by a heater into a drum and thereby dries the load. Clothes dryers may be roughly categorized into an exhaust type clothes dryer and a condensation type clothes dryer, according to the method employed for handling the humid air occurring when absorbing the moisture and drying the load.

The exhaust type clothes dryer employs a method for exhausting the humid air flowing from the drum to the outside of the dryer. However, it requires an exhaust duct for exhausting the moisture evaporated in the drum to the outside. In particular, when gas heating is employed, the exhaust duct needs to be installed being extended long enough to the outdoors, considering that carbon monoxide, etc. as a product of combustion are also exhausted.

The condensation type clothes dryer uses a recirculation method that removes moisture by condensing the moisture from the humid air flowing from the drum in a heat exchanger and then re-circulates the moisture-removed dry air back into the drum. However, the drying air flow forms a closed loop, making it difficult to use gas as a heating source.

A ductless dryer overcomes the demerits of the exhaust type dryer and the condensation type dryer. That is, the ductless dryer uses a method that removes moisture by condensing the moisture from the humid air flowing from the drum in a heat exchanger and then exhausts the moisture-removed dry air to the outside. Accordingly, the ductless dryer can be maintained at a low cost by using gas as the heating source and does not require an additional exhaust duct to be extended to the outdoors.

Meanwhile, the condensation type dryer and the ductless dryer may include a filter for filtering lint, since the lint detached from laundry during a drying operation may be contained in air coming out of the drum and thereby be introduced to the heat exchanger. However, an installation of the filter cannot completely prevent a leakage of lint.

For instance, a screen filter is formed of a plastic material, and a portion where the screen filter is installed is formed of steel. Accordingly, due to such different materials, it is difficult to completely seal the screen filter and the installation portion of the screen filter, thereby causing the leakage of lint. A butterfly filter as another example also causes the leakage of lint due to the lack of a sealing structure in a portion where the butterfly filter is installed.

The thusly leaked lint is introduced into the heat exchanger with air, and accumulated (piled up) on a surface of the heat exchanger. In the condensation type dryer, air flowing from the heat exchanger may not be smoothly circulated by a resistance due to such lint. In the ductless dryer, the air flowing from the heat exchanger may not be smoothly exhausted to the outside, thereby deteriorating drying performance. In addition, due to the link accumulated on the surface of the heat exchanger, heat cannot be smoothly exchanged in the heat exchanger, thereby deteriorating heat exchange efficiency.

The above references are incorporated by reference herein where appropriate for appropriate teachings of additional or alternative details, features and/or technical background.

DISCLOSURE OF INVENTION

Technical Problem

Therefore, an object of the present invention is to provide a dehumidifying apparatus for a dryer which can prevent accumulation of foreign substances (e.g., lint, etc.), introduced into the dehumidifying apparatus, on a heat exchanger.

Another object of the present invention is to provide a dehumidifying apparatus for a dryer which can remove foreign substances (e.g., lint, etc.), introduced into the dehumidifying apparatus for a dryer and accumulated on a heat exchanger, from a surface of the heat exchanger.

Technical Solution

According to one aspect of the present invention, there is provided a dehumidifying apparatus for a dryer comprising: a case; a drum disposed inside the case and for receiving objects to be dried therein; and a hot air supplying unit for supplying hot air into the drum and drying the objects to be dried, the dehumidifying apparatus, comprising: a heat exchanger for heat exchange with air flowing from the drum; and an injection nozzle portion disposed between the hot air supplying unit and the heat exchanger so as to inject a certain jet.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

BEST MODE FOR CARRYING OUT THE INVENTION

Description will now be given in detail of the dehumidifying apparatus for a dryer according to the preferred embodiments of the present invention, examples of which are illustrated in the accompanying drawings. Here, the dehumidifying apparatus for a dryer is not limited to a ductless dryer, but may also be applied to various types of dryers, such as a general condensation type dryer, and the like.

Figure 1:
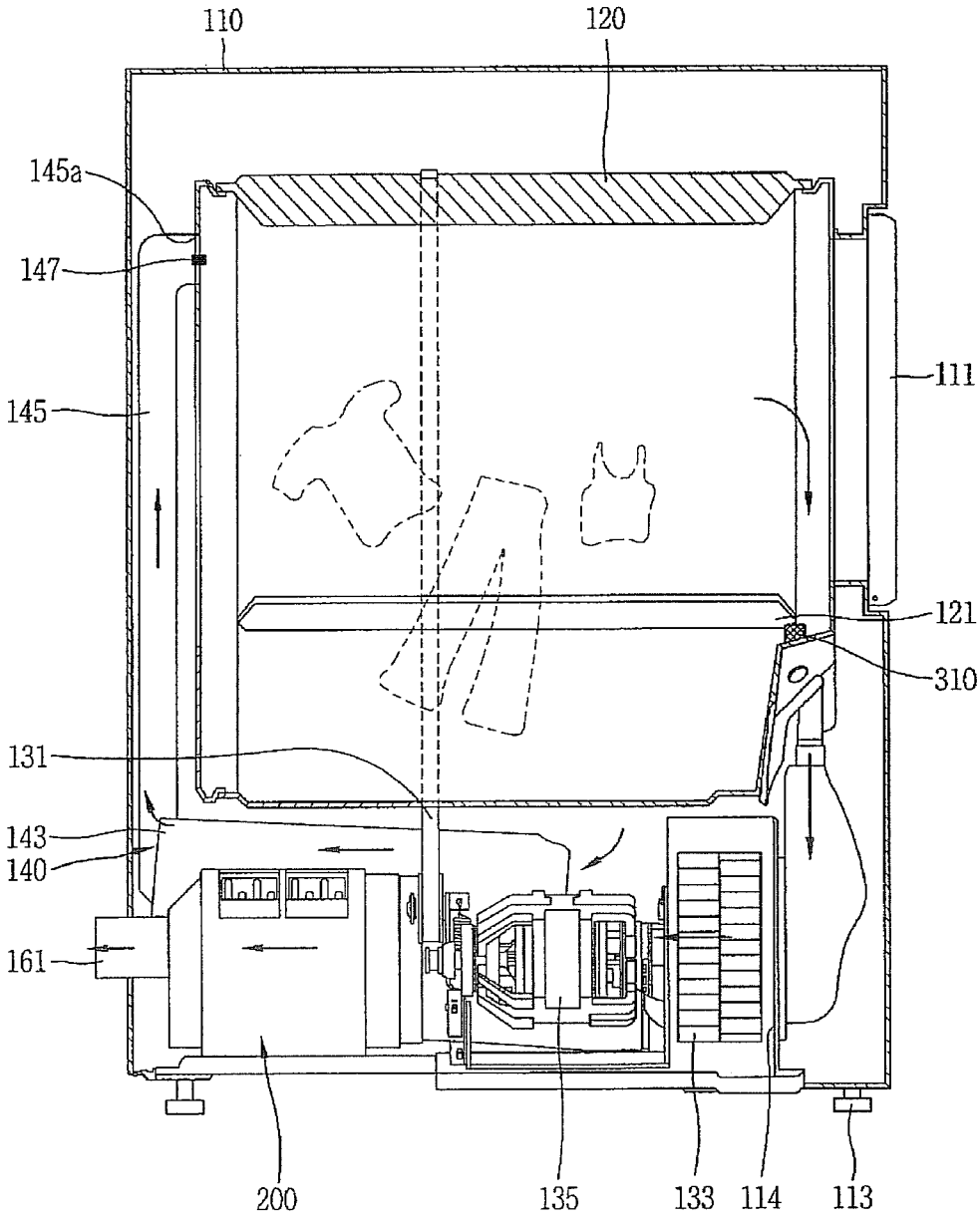
FIG. 1 is a schematic view of a dryer to which a dehumidifying apparatus is employed according to a first embodiment of the present invention.
Figure 2:
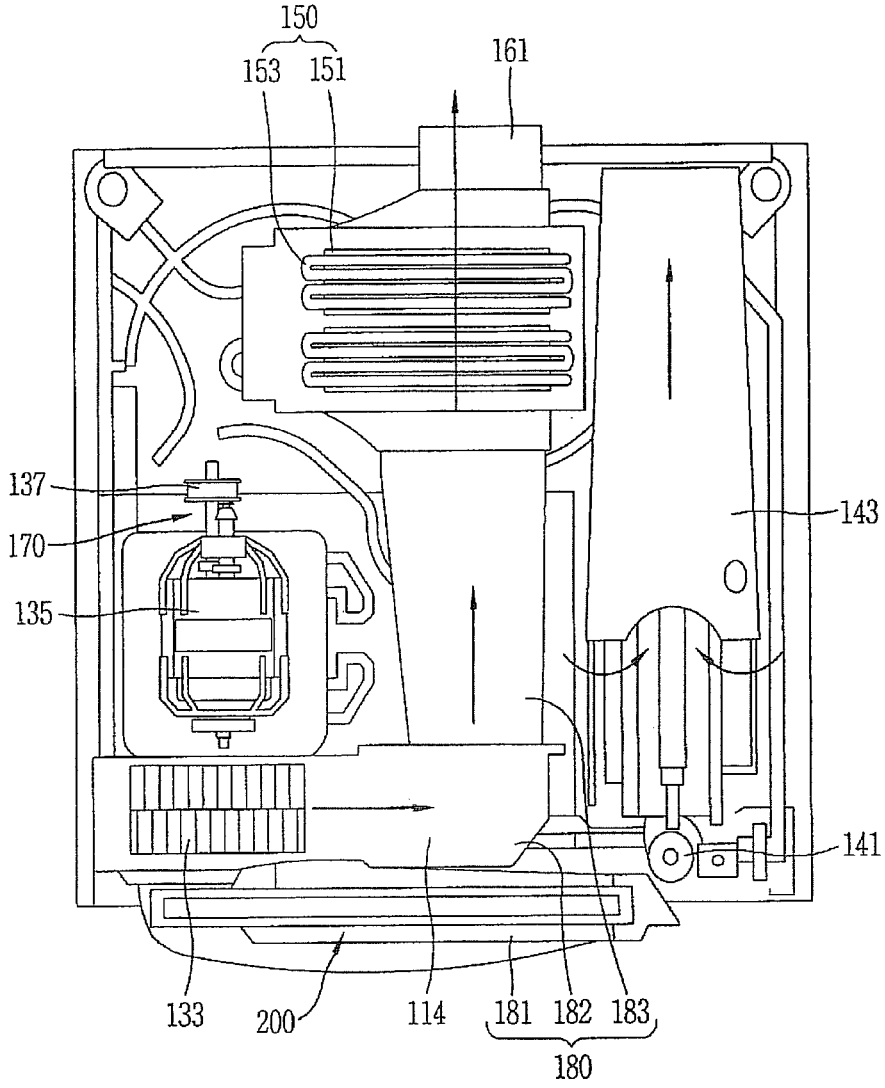
FIG. 2 is a plane view showing the dryer to which the dehumidifying apparatus is employed according to the first embodiment of the present invention.

FIG. 1 is a schematic view of a dryer to which a dehumidifying apparatus is employed according to a first embodiment of the present invention. FIG. 2 is a plane view showing the dryer to which the dehumidifying apparatus is employed according to the first embodiment of the present invention. Arrows indicate the flow of air.

Referring to FIGS. 1 and 2, the ductless dryer according to a first embodiment of the present invention may include a main body 110; a drum 120 rotatably mounted at the main body 110; a hot air supplying unit 140 supplying hot air into the drum 120; a heat exchanger 150 removing moisture contained in the air exhausted from the drum 120; a circulation duct 180 conducting the air exhausted from the drum 120 to the heat exchanger 150; a filter 200 installed in the circulation duct 180 and filtering lint contained in the air coming out of the drum 120; and a sealing unit preventing the leakage of lint through a gap of an installation portion where the filter 200 is installed.

A door 111 is mounted on a front surface of the main body 110 to enable loading of clothes into the drum 120. A foot 113 is disposed at a lower portion of the main body 110 to support the main body 110. A belt 131 for rotating the drum 120 and a motor 135 for supplying a driving force to the belt 131 are mounted inside the main body 110. A pulley 137 for winding the belt 131 is disposed on a shaft of the motor 135.

The drum 120 is a container having an inner space into which clothes, etc., as objects to be dried, can be loaded. A plurality of lifters 121 are installed inside the drum 120 so as to lift the clothes.

The hot air supplying unit 140 includes a valve 141 controlling the supplying of gas, a gas burner 143 mixing the gas supplied from the valve 141 with an air supplied from the outside, igniting it, and then generating hot air, and a hot air supplying duct 145 communicating the gas burner 143 with the drum 120 so as to supply the generated hot air to the drum 120. In order to indirectly determine the amount of carbon monoxide (CO) emissions through a numerical value of a flame current by detecting the flame current, a flame rod extending to an edge of a flame may be installed in the hot air supplying unit 140.

Preferably, the valve 141 is implemented as a solenoid valve so as to sensitively adjust the amount of gas supplied.

While being supplied by the valve 141, the gas burner 143 heats the air with the heat generated when the gas supplied from the valve 141 is mixed with the outside air and then burned. The hot air generated by being thusly heated is provided to the drum 120 through the hot air supplying duct 145.

The heat exchanger 150 includes fins 151 and a tube 153. The heat exchanger 150 condenses moisture from the air of high temperature and humidity coming out of the drum 120 through a heat exchange method of air to water by using water of low temperature, to thereby dry the air. An inlet of the heat exchanger 150 is connected to the drum 120 by the circulation duct 180, and an outlet thereof is connected to an exhaust duct 161.

The fins 151 are thin metallic plates having excellent thermal conductivity and are laminated as a plurality of thin vertical metallic plates having a minute distance therebetween so as to contact the air of high temperature and humidity as it passes through.

Water of low temperature (22.degree. C.) is circulated through the tube 153. The tube 153 penetrates the fins 151 in a serpentine manner. Both ends of the tube 153 are connected to water lines (not shown) for supplying and draining water of low temperature. A water container (not shown) for collecting condensed water, which is generated during the condensation process and dropped, is installed at a lower portion of the heat exchanger 150.

The circulation duct 180 includes a filter installation duct 181 providing a space where the filter 200 is installed, a fan installation duct 182 connected to the filter installation duct 181 and providing a space where the fan 133 is installed, and a connection duct 183 for connecting the fan installation duct 182 and the heat exchanger 150. Here, the fan 133 is connected to a shaft of the motor 135 and is supplied a driving force from the motor 135. To be certain, a plurality of motors 135 may be provided so as to respectively supply a driving force to the belt 131 and the fan 133.

Figure 3:
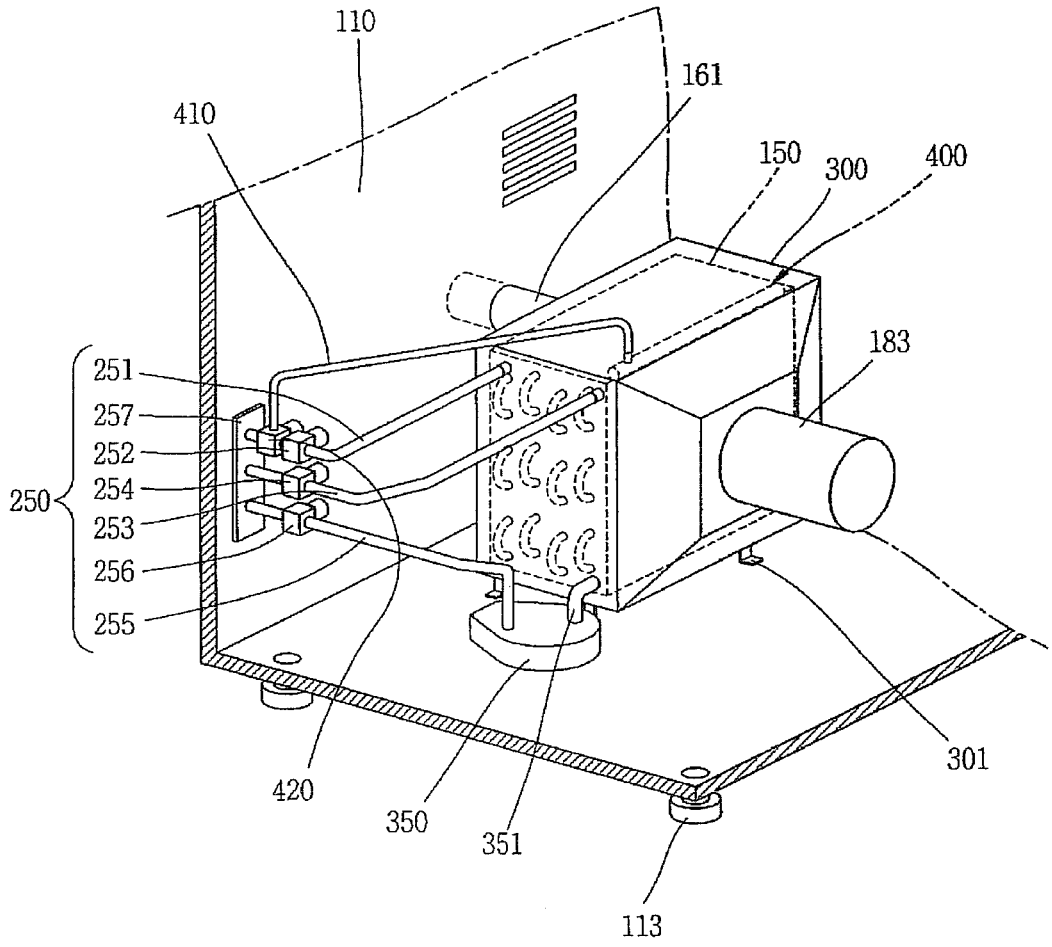
FIG. 3 is a perspective view of the dehumidifying apparatus for the dryer according to the first embodiment of the present invention.
Figure 4:
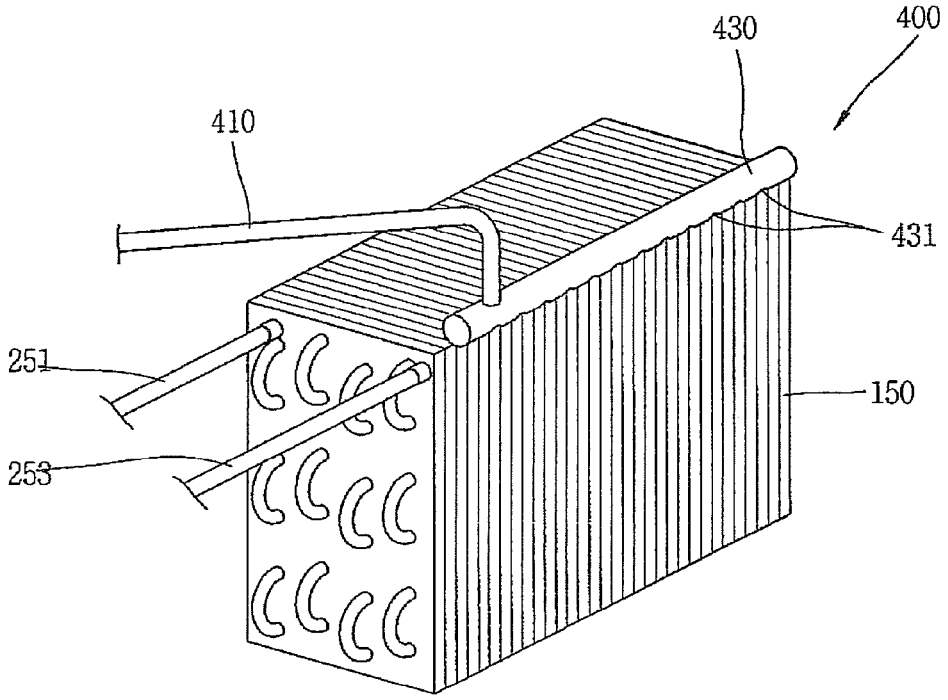
FIG. 4 is a perspective view of an injection nozzle portion of the dehumidifying apparatus for the dryer according to the first embodiment of the present invention.
Figure 5:
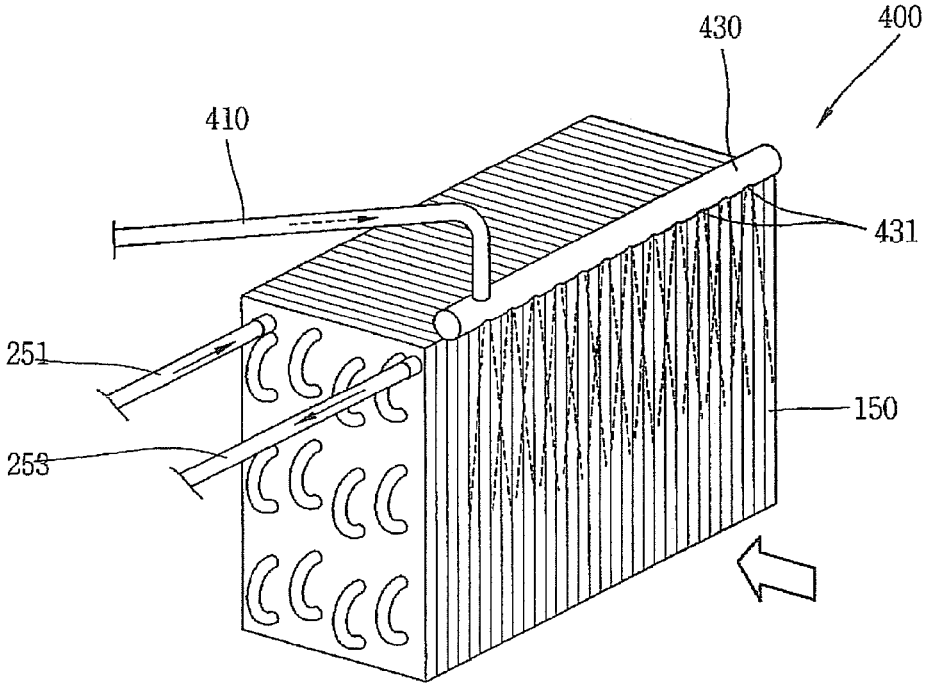
FIG. 5 is a perspective view showing an operation of the injection nozzle portion according to the first embodiment of the present invention.
Figure 6:
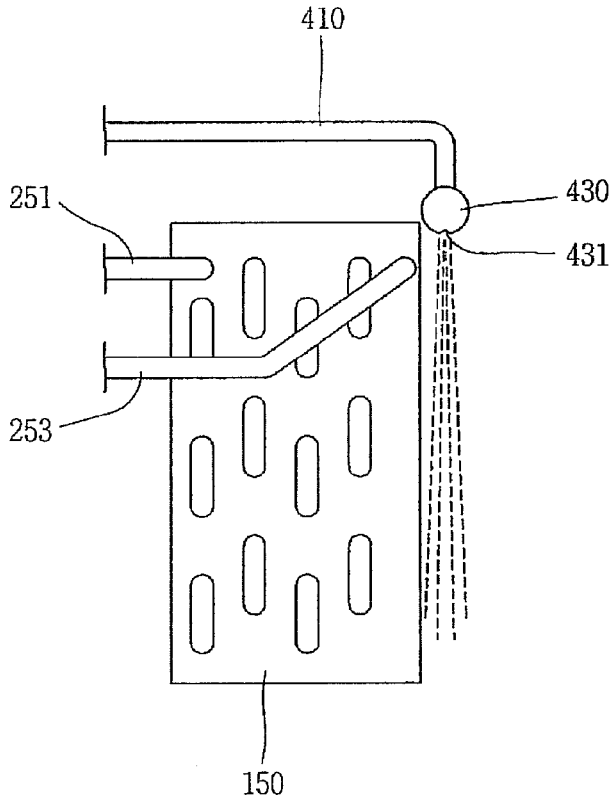
FIG. 6 is a side view showing the operation of the injection nozzle portion according to the first embodiment of the present invention.

FIG. 3 is a perspective view of the dehumidifying apparatus for the dryer according to the first embodiment of the present invention. FIG. 4 is a perspective view of an injection nozzle portion of the dehumidifying apparatus for the dryer according to the first embodiment of the present invention. FIG. 5 is a perspective view showing an operation of the injection nozzle portion according to the first embodiment of the present invention. FIG. 6 is a side view showing the operation of the injection nozzle portion according to the first embodiment of the present invention.

Referring to FIGS. 3 through 6, the heat exchanger 150 and a condenser case 300 for covering the heat exchanger 150 are formed at a lower surface of the dryer main body 110 according to this embodiment. The connection duct 183 is communicated with one side of the condenser case 300, and the exhaust duct 161 is communicated with another side thereof.

The heat exchanger 150 is installed inside the condenser case 300 which entirely covers the heat exchanger 150. The condenser case 300 may be tightly sealed so as to maintain its sealed state.

A refrigerant flowing through the tube 153 is heat-exchanged with air introduced from the drum 120 through the connection duct 183 in the heat exchanger 150. Water may be used as such refrigerant. During the heat exchange, the moisture contained in the air is condensed, thereby generating condensate water. The condensate water flows along the heat exchanger 150, and is directed to the lower portion of the condenser case 300.

The lower portion of the condenser case 300 serves as a container (water tank) for containing the condensate water flowing down from the heat exchanger 150. A lowermost water tank 350 is disposed at one side of the condenser case 300 so as to be communicated with the lower portion of the condenser case 300 (i.e., the water tank) by a communication pipe 351.

The lowermost water tank 350 is disposed at a relatively lower position than the water tank (i.e., the lower portion of the condenser case 300). Accordingly, the condensate water contained in the lower portion of the condenser case 300 may be introduced to the lowermost water tank 350.

The lowermost water tank 350 is connected to a condensate water outlet pipe 255. The lowermost water tank 350 may further include a pump. Then, the condensate water received in the lowermost water tank 350 by the pump may be drained to the outside through the condensate water outlet pipe 255.

Meanwhile, the condensate water outlet pipe 255, a refrigerant inlet pipe 251, a refrigerant outlet pipe 253, and a pipe coupling plate 257 may form to be one assembly for modularization. Such module is implemented as a pipe module 250 as shown in FIG. 3. The modularization of the pipes facilitates installation and removal processes of the pipes.

Here, the refrigerant inlet pipe 251 is a path (passage) through which a refrigerant (e.g., water) is introduced to the heat exchanger 150 from the outside. The refrigerant outlet pipe 253 is a path (passage) through which the refrigerant flowing from the heat exchanger 150 is discharged to the outside.

Reference numerals 252, 254 and 256 denote control valves for each pipe. The control valve is implemented as a solenoid valve.

In this embodiment, an injection nozzle portion 400 is installed above the heat exchanger 150. The injection nozzle portion 400 may include an injection nozzle 430 having a plurality of injection holes 431, and a nozzle connection pipe 410 for connecting the injection nozzle 430 and the refrigerant inlet pipe 251.

A control valve 420 is installed at a connection portion of the nozzle connection pipe 410 and the refrigerant inlet pipe 251. The control valve 420 is configured to open/close the nozzle connection pipe 410 so as to control the supplying of water to the nozzle connection pipe 410 from the refrigerant inlet pipe 251.

Water introduced through the nozzle connection pipe 410 is fresh water supplied through the refrigerant inlet pipe 251. Water may be supplied by connecting a separate channel, other than the refrigerant inlet pipe 251, to the nozzle connection pipe 410, in addition to connecting the refrigerant inlet pipe 251 and the nozzle connection pipe 410.

Water supplied through the nozzle connection pipe 410 is sprayed (injected) through the injection holes 431 of the injection nozzle 430. As shown in FIG. 6, the sprayed water flows down along a front of the heat exchanger 150, forming a water curtain. Then, gas introduced to the heat exchanger 150 from the drum 120 passes through the sprayed water, thereby being separated from foreign substances (e.g., lint, etc.) contained in the gas. Accordingly, the heat exchanger 150 can be prevented from accumulation of the foreign substances such as lint, and the like.

The descending water having thusly removed the lint contained in the gas may be contained in the water tank at the lower portion of the condenser case 300. The water is introduced into the lowermost water tank 350 along with condensate water formed at the heat exchanger 150, thereby being discharged to the outside.

Here, water sprayed through the injection nozzle 430 has relatively low temperature when compared to gas introduced into the heat exchanger 150. Accordingly, moisture contained in the gas may be primarily condensed while passing the water sprayed from the injection nozzle 430, thereby enhancing heat exchange efficiency of the dehumidifying apparatus.

Meanwhile, a jet introduced through the nozzle connection pipe 410 may be gas, in addition to water. In this case, a compressor (not shown) may be further included to compress gas as the jet.

Hereinafter, another embodiment of the present invention will be described in detail. Same explanations as those given in the first embodiment of the present invention are omitted.

Figure 7:
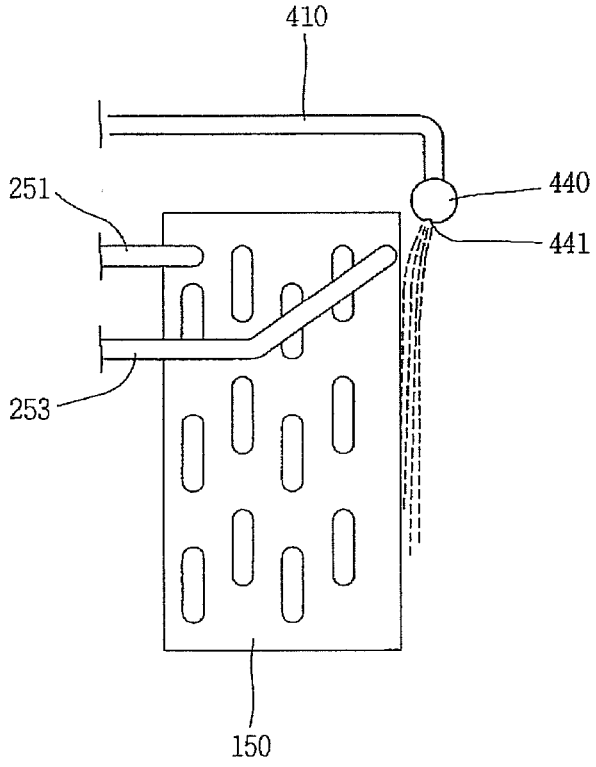
FIG. 7 is a side view showing an operation of an injection nozzle portion in a dehumidifying apparatus for a dryer according to a second embodiment of the present invention.

FIG. 7 is a side view showing an operation of an injection nozzle portion in a dehumidifying apparatus for a dryer according to a second embodiment of the present invention.

Referring to FIG. 7, injection holes 441 of an injection nozzle 440 are formed to face the heat exchanger 150.

With the configuration, water supplied to the injection nozzle 440 is sprayed toward the heat exchanger 150. Then, the sprayed water may wash (clean) the surface of the heat exchanger 150. Accordingly, foreign substances such as lint, etc. adhered onto the surface of the heat exchanger 150 may be removed, thereby enhancing the heat exchange efficiency of the heat exchanger 150.

Meanwhile, the injection holes 441 of the injection nozzle 440 are formed in multiple directions. Water may be sprayed toward the heat exchanger 150 as shown in FIG. 7, as well as the water may flow down along the front of the heat exchanger 150 so as to form the water curtain as shown in FIG. 6.

Figure 8:
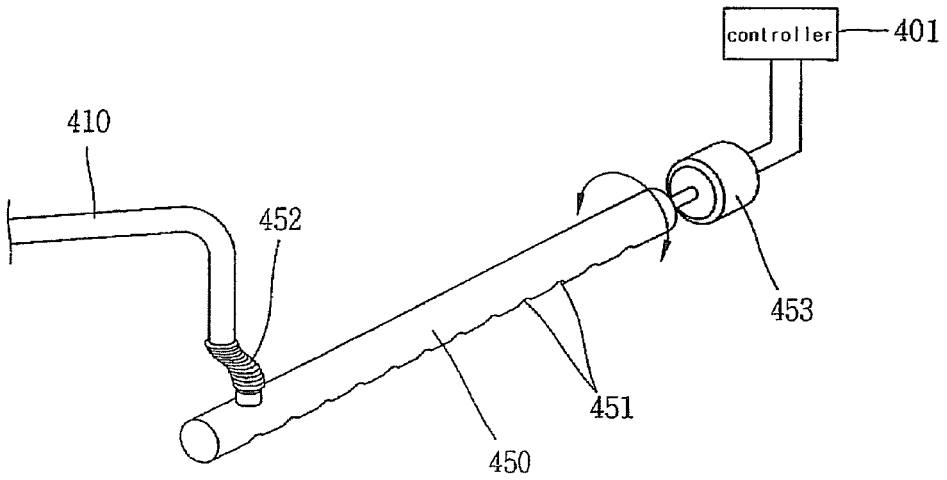
FIG. 8 is a view showing an injection nozzle portion adopted by the dehumidifying apparatus for a dryer according to a third embodiment of the present invention.

FIG. 8 is a view showing an injection nozzle portion adopted by the dehumidifying apparatus for a dryer according to a third embodiment of the present invention.

Referring to FIG. 8, an injection nozzle 450 configured to spray water to the heat exchanger 150 may be rotated within a predetermined angle by a driving motor 453. An operation of the driving motor 453 is controlled by a controller 401.

A flexible pipe 452 capable of being flexibly deformed is disposed between a nozzle connection pipe 410 for supplying water to the injection nozzle 450 and the injection nozzle 450.

With such configuration, as the driving motor 453 controlled by the controller 401 is driven, the injection nozzle 450 may be rotated within the predetermined angle. Accordingly, an injection direction of a plurality of injection holes 451 formed at the injection nozzle 450 may be controlled, for instance, water may be sprayed onto the surface of the heat exchanger 150, water may flow down along the front of the heat exchanger 150 so as to form a curtain shape (water curtain), or water may be periodically supplied to the surface of the heat exchanger 150 and the front of the heat exchanger 150 in an alternating manner.

Figure 9:
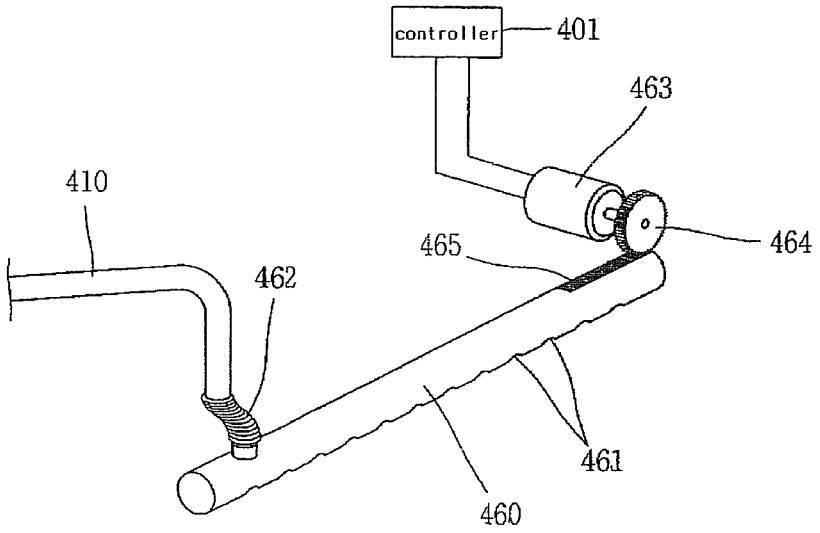
FIG. 9 is a view showing an injection nozzle portion adopted by the dehumidifying apparatus for a dryer according to a fourth embodiment of the present invention.

FIG. 9 is a view showing an injection nozzle portion adopted by the dehumidifying apparatus for a dryer according to a fourth embodiment of the present invention.

Referring to FIG. 9, an injection nozzle 460 configured to spray water to the heat exchanger 150 may be moved within a predetermined range by a driving motor 463. An operation of the driving motor 463 is controlled by the controller 401.

A flexible pipe 462 capable of being flexibly deformed is disposed between the nozzle connection pipe 410 for supplying water to the injection nozzle 460 and the injection nozzle 460. Gears 464, 465 engaged with each other are formed between the motor 463 and the injection nozzle 460 such that a driving force generated by the motor 463 is transferred to the injection nozzle 460.

With such configuration, as the driving motor 463 controlled by the controller 401 is driven, the injection nozzle 460 may be moved within the predetermined range. Accordingly, a direction of water sprayed from a plurality of injection holes 461 formed at the injection nozzle 460 may be controlled, thereby capable of intensively washing a specific portion of the heat exchanger 150 (or forming an intensive water curtain).

According to the dehumidifying apparatus for a dryer in one aspect of the present invention, water supplied through the nozzle connection pipe is sprayed through the injection holes. The thusly sprayed water flows down along the front of the heat exchanger, forming the water curtain. Then, gas introduced into the heat exchanger from the drum passes through the sprayed water, thereby being separated from the foreign substances, such as lint, etc. contained in the gas. Therefore, the heat exchanger may be prevented from the accumulation of the foreign substances.

In addition, according to the dehumidifying apparatus for a dryer, the jet sprayed through the injection nozzle is comprised of water of relatively low temperature when compared to gas introduced into the heat exchanger. Then, moisture contained in the gas may be primarily condensed when passing the water sprayed from the injection nozzle, thereby enhancing heat exchange efficiency of the dehumidifying apparatus.

In addition, according to the dehumidifying apparatus for a dryer, the injection holes of the injection nozzle are formed to face the heat exchanger such that water supplied to the injection nozzle is sprayed toward the heat exchanger. Then, the sprayed water may wash the surface of the heat exchanger. Accordingly, the foreign substances (e.g., lint, etc.) adhered onto the surface of the heat exchanger may be removed, thereby enhancing the heat exchange efficiency of the heat exchanger.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dehumidifying apparatus for a dryer, the dryer including a case; a drum disposed inside the case that receives objects to be dried therein; and a hot air supplier that supplies hot air into the drum and dries the objects to be dried, the dehumidifying apparatus comprising:

a heat exchanger that cools air flowing from the drum;

an injection nozzle disposed upstream of the heat exchanger that injects a predetermined material toward the heat exchanger, thereby removing foreign substances on the heat exchanger, wherein the injection nozzle is configured to be movable, and wherein the injection nozzle is disposed above the heat exchanger;

a drive motor; and a flexible pipe capable of being flexibly deformed, disposed between the injection nozzle and a pipe that supplies the predetermined material to the injection nozzle, wherein the flexible pipe allows the injection nozzle to move via the drive motor in a state in which the pipe that supplies the predetermined material to the injection nozzle is fixed, and wherein a first end of the injection nozzle is connected to the flexible pipe and a second end of the injection nozzle is connected to the drive motor.

2. The dehumidifying apparatus of claim 1, wherein the injection nozzle is configured to be movable so as to adjust an injection direction of the predetermined material.

3. The dehumidifying apparatus of claim 2, wherein the drive motor is configured to drive the injection nozzle to rotate, and wherein a controller controls the drive motor so that the injection nozzle is rotatable within a predetermined angle.

4. The dehumidifying apparatus of claim 3, wherein the controller controls the drive motor to operate for a predetermined period of time.

5. The dehumidifying apparatus of claim 1, wherein the injection nozzle is configured to be movable so as to adjust an injection range of the predetermined material.

6. The dehumidifying apparatus of claim 5, wherein the drive motor is configured to generate a drive force, wherein a plurality of gears transfers the drive force of the drive motor to the injection nozzle, and wherein a controller controls the drive motor so that the injection nozzle moves within the predetermined range.

7. The dehumidifying apparatus of claim 6, wherein the controller controls the drive motor to operate for a predetermined period of time.

8. The dehumidifying apparatus of claim 1, wherein the injection nozzle injects at least a portion of the predetermined material into the air introduced into the heat exchanger.

9. The dehumidifying apparatus of claim 1, wherein the injection nozzle injects at least a portion of the predetermined material toward the heat exchanger.

10. The dehumidifying apparatus of claim 1, wherein the injection nozzle injects the predetermined material downwardly.

11. The dehumidifying apparatus of claim 1, wherein the injection nozzle includes a plurality of injection holes that injects the predetermined material.

12. The dehumidifying apparatus of claim 1, wherein the predetermined material injected from the injection nozzle is contained in a water tank that receives condensate water discharged by being condensed from the air.

13. The dehumidifying apparatus of claim 1, wherein the predetermined material injected from the injection nozzle is of a relatively low temperature compared to the air introduced into the heat exchanger.

14. The dehumidifying apparatus of claim 1, wherein the predetermined material injected from the injection nozzle comprises water.

15. The dehumidifying apparatus of claim 1, wherein the predetermined material injected from the injection nozzle comprises air.

16. The dehumidifying apparatus of claim 15, further including:

a compressor that compresses the air.

17. A dryer including the dehumidifying apparatus of claim 1, a case, a drum disposed inside the case that receives objects to be dried therein, and a hot air supplier that supplies hot air into the drum and dries the objects to be dried.

* * * * *